United States Patent [19]

Hilding

[11] 4,241,742

[45] Dec. 30, 1980

[54] ASHTRAY TO CONTROL BURNING RATE OF CIGARETTE

[76] Inventor: Arthur W. Hilding, 1634 Creek Dr., San Jose, Calif. 95125

[21] Appl. No.: 41,697

[22] Filed: May 23, 1979

[51] Int. Cl.[3] ..... A24F 13/18; A24F 19/14

[52] U.S. Cl. ..... 131/235 R; 131/240 R

[58] Field of Search ..... 131/231, 235 R, 240 R, 131/241

[56] References Cited

U.S. PATENT DOCUMENTS

| | | | |
|---|---|---|---|
| 1,813,467 | 7/1931 | Smith | 131/235 R |
| 2,111,172 | 3/1938 | Cook | 131/235 R |
| 2,184,994 | 12/1939 | Dyke | 131/235 R |
| 2,327,452 | 8/1943 | Powers | 131/240 R |
| 2,404,174 | 7/1946 | Hines | 131/235 R |

FOREIGN PATENT DOCUMENTS

| | | | |
|---|---|---|---|
| 837482 | 4/1952 | Fed. Rep. of Germany | 131/235 R |
| 1010443 | 6/1952 | France | 131/235 R |
| 952846 | 3/1964 | United Kingdom | 131/235 R |

*Primary Examiner*—Stephen C. Pellegrino

*Attorney, Agent, or Firm*—Gerald L. Moore

[57] ABSTRACT

An ashtray having grooves configured to receive and hold the cigarette for slowing the burning rate thereof and for extinguishing it before it burns to the end. The primary improvement is the elimination of tar and moisture condensate on the cigarette.

3 Claims, 7 Drawing Figures

ASHTRAY TO CONTROL BURNING RATE OF CIGARETTE

BACKGROUND OF THE INVENTION

When a lighted cigarette is placed in an ashtray, the cigarette continues to burn and pollute the atmosphere. Such burning also reduces the overall smoking time of each cigarette. If the cigarette is left unattended long enough, there is the possibility of it burning to the point of becoming overbalanced and falling from the ashtray. This displaced cigarette can cause fires.

Numerous ashtrays have been made to limit the burning rate of unattended cigarettes. For the most part they have included the positioning of the cigarette into a slot to limit the air flow around the cigarette and reduce the oxygen necessary for combustion. The effect is that the burning of the cigarette will slow, thereby reducing the amount of smoke generated. Examples of this type of ashtray are shown in U.S. Pat. No. 2,404,174, Hines, issued on July 16, 1946 and U.S. Pat. No. 2,184,994, Dyke, issued on Dec. 26, 1939. Both of these patents relate to ashtrays having grooves in which a cigarette is placed to limit the air flow to the cigarette. Both patents also mention the condensate on the cigarette and attempt to alleviate this problem.

The condensate exists in such ashtrays from condensation on and around the cigarette resting on the ashtray. The condensate comprises both moisture and tar or nicotine derivatives, which both stain and wet portions of the cigarette surface as well as the ashtray surfaces immediately adjacent the cigarette. These deposits are unpleasant to the smoker in that they stain the cigarette paper and can cause uneven burning across the cigarette because of the paper becoming moist. In addition the smoker may, in some instances, be able to taste the unpleasant deposits on the cigarette paper.

In the above-identified U.S. Pat. No. 2,404,174 it is noted that the sides of the groove are positioned out of contact with the cigarette in an attempt to prevent sweating or water condensation. The patent to Dyke also attempts to reduce condensation by positioning the cigarette out of contact with the grooved surfaces. Dyke notes specifically that the condensation or sweating takes place where the cigarette touches the tray.

It is the purpose of the present invention to provide an ashtray and a method for limiting the burning rate of an unattended cigarette and for preventing the condensation of water and tars on the cigarette and the ashtray.

SUMMARY OF THE INVENTION

The method and apparatus for storing a burning cigarette to slow the burning process and lessen the smoke generated comprising the placing of a cigarette in a groove formed in an ashtray and means to maintain the groove and the cigarette at a temperature substantially above ambient temperature while limiting the flow of air about the cigarette to slow the rate of burning and prevent condensation on and around the cigarette.

DESCRIPTION OF THE INVENTION

Figure 1:
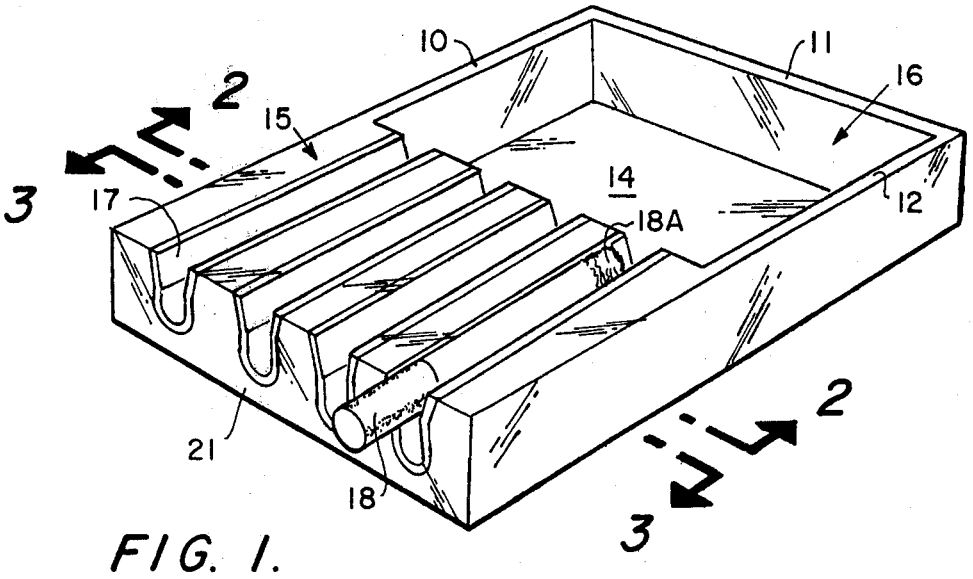
FIG. 1 is a perspective of an ashtray incorporating the invention.

In FIG. 1 is shown an ashtray having side walls 10, 11 and 12 and a bottom wall 14. A cigarette holder 15 forms the remaining side of the ash container 16. The cigarette holder includes a plurality of grooves 17 of sufficient length to hold the entire burnable end of a cigarette 18. These grooves are configured to hold the cigarette in a manner to prevent tilting or falling from the ashtray and to limit the rate of burning. In addition the grooves are formed to hold the cigarette after extinguishment.

In accordance with the present invention, the grooves are maintained at a temperature substantially above ambient temperature for the purpose of eliminating condensation of moisture and tars on the cigarette and on the groove surfaces. The holder 15 includes a plurality of elongated members 19 extending parallel and in spaced relationship away from the ash holder 16. The adjacent walls 19A of the members 19 form a first groove 20 extending to and joining with the ash receptacle 16. One end of this first groove is partially closed by a ledge 21 positioned at the opposite end from the ash receptacle.

Fixed within the first groove 20 is a liner 22 which forms a second groove 24 sized for holding a cigarette 18. Preferably the walls of the ash receptacle 16 and the elongated members 19 are made of a nonflammable material having sufficient mass to provide the rigidity for the receptacle and the first grooves. Usually this part of the ashtray is formed of glass, plastic or other material which is unburnable, can be molded and has a sufficiently pleasing appearance. Experience has shown that condensation takes place in the areas of the groove around the cigarette and on the cigarette under usual conditions. These conditions generally involve air circulation around the cigarette placed in certain configurations of such cigarette holders. In accordance with the present invention, the holder is constructed to alleviate the condensation around the cigarette which otherwise can result in stains on the cigarette and moisture settling on the cigarette paper which adversely affects the smoker's enjoyment.

Figure 6A:
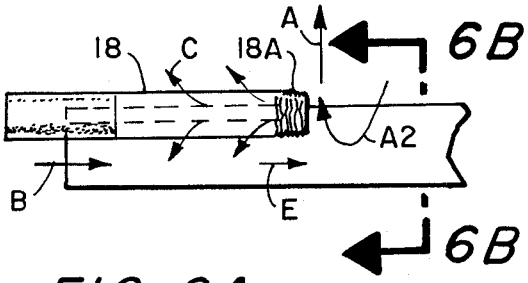
FIG. 6A. PRIOR ART
FIGS. 6A & 6B show a prior art ashtray.
Figure 6B:
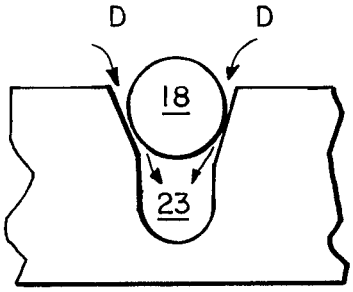
FIG. 6B. PRIOR ART

As shown in FIGS. 6A and 6B, several air currents are present in the vicinity of the burning cigarette placed in the prior devices. For instance there is the connection current involving the environmental air illustrated by the arrows A and A2. The arrow A represents rising hot air and gas from the burning tip 18A of the cigarette 18, which rising air is replaced by the current A2 representing the room air which carries with it some moisture. This connection current also causes the flow B through the channel 23. Also entering this channel is the flow C representing smoke exiting the cigarette through the porous paper cigarette wall.

The smoke C carries with it the tar and nicotine vapors as well as moisture from the burning cigarette materials. In addition, there enters the channel 23 the air flow D from the room if the cigarette does not form a tight seal with the channel wall.

Thus the flow E represents the moisture bearing air B from the room and the tar, nicotine and moisture bearing smoke C from the cigarette. This gas mixture E is cooled by the convection flow $A_2$ or by the walls of the channel 23. The result is the formation of condensate on the channel walls and the cigarette paper facing the channel 23. The deposit of tars and moisture on the cigarette causes unsightly discoloration of the cigarette paper and frequently results in an unpleasant taste for the smoker. The condensate on the channel walls 19A eventually is deposited onto the cigarette paper when subsequent cigarettes are placed into the groove.

In addition it has been found that as the walls 18A of the channel cool, a cooling effect is imparted to the cigarette. Such cooling has two adverse effects, firstly the burning tip temperature is lowered, secondly the cigarette body in being cooled causes the tars and nicotines to condense from the smoke when the smoker again draws on the cigarette thereby detracting from the enjoyment of the smoker.

Accordingly there is positioned within the groove 19 the member 22 supported by the top projections 24 contacting the groove side walls 19A. The member 22 is positioned in spaced relationship with the groove 19 in a manner to form an insulating air space 25 therebetween. The member 22 is made of a heat conducting material extending along the burning length of the cigarette.

Figure 2:
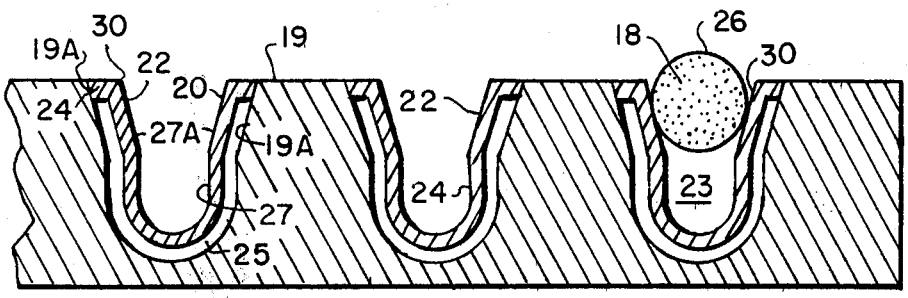
FIG. 2 is a partial cross-sectional view along the line 2—2 of FIG. 1.
Figure 3:
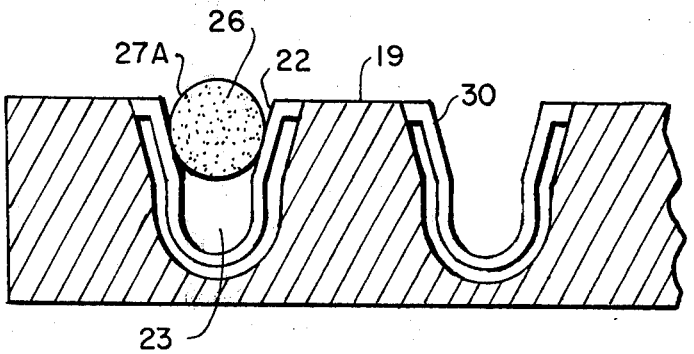
FIG. 3 is a partial cross-sectional view along the line 3—3 of FIG. 1.
Figure 4:
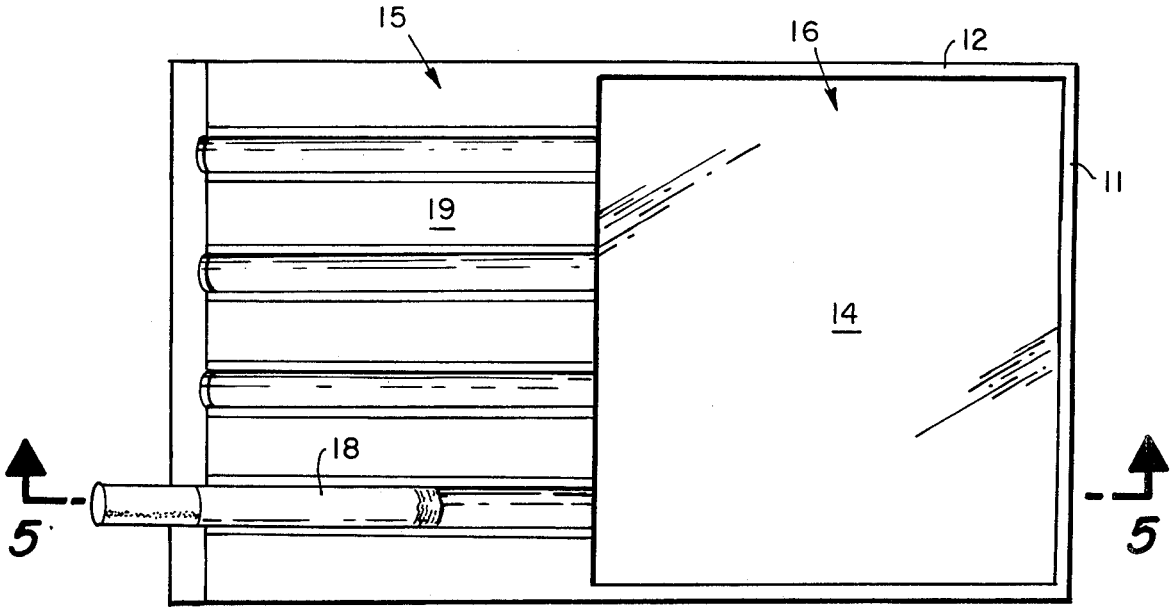
FIG. 4 is a top view of the ashtray.
Figure 5:
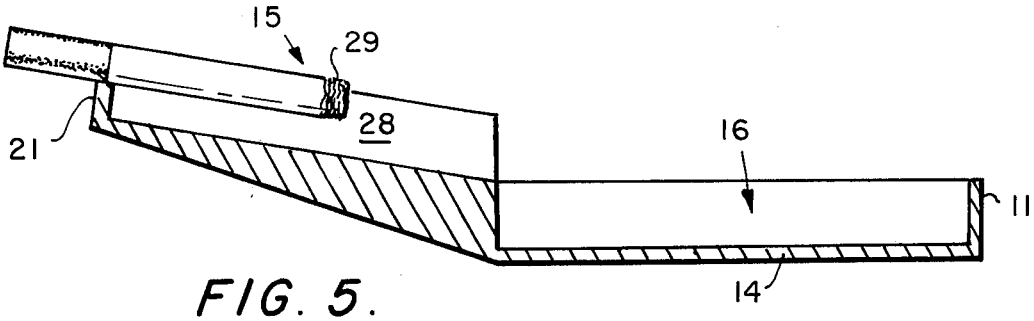
FIG. 5 is a cross-sectional view along the line 5—5 of FIG. 4.

With the construction shown, the cigarette 18 is positioned in the second groove 17 formed by the member 22. The cigarette fits closely against the angular areas 27A of the groove walls in the manner shown in FIGS. 2 and 3 to seal against air flow between the cigarette and the secondary groove side walls. The ledge 21 substantially seals the end of the chamber 23 so as to limit air flow lengthwise within that chamber. The burning end 18A (FIG. 1) of the cigarette serves to heat the member 22 to raise the temperature thereof above ambient room temperature. Because the member is made of a good conductor, the temperature throughout the total length remains at a temperature elevated substantially above ambient temperature because it is isolated from the body members 19 by the air space 25. Thus heat conduction away from the member 22 is reduced substantially.

Tests of various ashtrays of the general type described without the described improvement have shown that condensates of moisture and tar form primarily on the underside of the cigarette and on the adjacent side walls of a groove made in accordance with the prior art devices. Such deposits are discussed in some of the prior references. The subject invention recognizes the importance of maintaining the air and smoke in the chamber 23 at a sufficient temperature to prevent the condensation of moisture, tars and nicotine carried in the smoke. While some of the moisture in the smoke originates from the burning of the cigarette containing moisture, other moisture in the chamber 23 is carried by air circulating past the cigarette and into the chamber due primarily to convection currents as discussed previously. Of course the tars and nicotine carried in the smoke emanate from the burning cigarette. In recognizing these difficulties due to condensates, the present invention serves to substantially eliminate condensation by limiting the flow of air into the chamber 23, by maintaining the air and gas within that chamber at a sufficiently high temperature to prevent such condensation and by preventing the smoke from encountering any cold surfaces adjacent the cigarette to cause condensation. Such is achieved by maintaining the side walls of the member 22 at a temperature substantially above ambient temperature by conducting from the burning end of the cigarette the heat throughout this member and by supporting this member in a manner so that the heat is substantially retained by the member.

Thus the member 22 is maintained at an elevated temperature by making it of a conductive material and by isolating this member from the remainder of the ashtray. Such is achieved by supporting this member by the upper projections 24 which contact the surface 19A of the body members 19. In past devices wherein the grooves are either formed of good heat conducting material such that the holder body serves as a heat sink to rapidly transmit any heat derived from the burning cigarette away from the groove walls by dissemination throughout the ashtray body, the groove forming body is made of a poor heat conducting material which fails to conduct heat along the entire length of the cigarette. In addition if the cigarette does not seal along the contact areas with the groove side walls, air can circulate into the cavity 23 to serve both to carry more moisture for condensation and also to further cool the side walls so as to aggravate the deposit of condensates.

The method by which the present invention eliminates condensates, especially on the cigarette but also on the ashtray walls, is by preventing the gas in the chamber 23 from coming into contact with ashtray surfaces which are at or below ambient temperature. In addition the present invention eliminates the circulation of air between the cigarette and the groove walls for the purposes previously stated. By maintaining the groove walls above ambient temperature, the condensation thereon is substantially eliminated. In addition the rate of burning of the cigarette is better controlled since the temperature of the groove side walls is predictable and sufficient to not cool the burning cigarette tip sufficiently to eliminate combustion entirely. With the elimination of the variable condition of air circulating around the cigarette, the size of the cavity 23 can be made to carry enough oxygen bearing air to support combustion at a preselected rate so that the cigarette remains burning yet at a controlled and predictable rate.

In addition it has been found important to form the edges 30 adjacent the cigarette with a radius no larger than 0.025 inches to limit the amount of air flow around the upper surface of the cigarette to further control the cooling of the member 22. Preferably the cigarette should be positioned within a slot having a lower slot width of approximately 0.240 inches with a 0.250 radius at the bottom thereof to provide space for ashes and sufficient room for the circulation of a small amount of oxygen-bearing air. The upper slot opening is preferably 0.375 inches wide with the angle of the slot being set at 16°. The slot thus holds the cigarette in a position with approximately 0.06 inches extending above the top surface 31 of the members 19 or for a slim cigarette approximately 0.02 inches above the top surface of that member. With this configuration the cigarette generally burns between approximately two and one-half to three and one-half minutes while laying unattended in the slot. It is estimated that smoke pollution is reduced approximately 90% in comparison to the use of conventional ashtrays. Usually the cigarette extinguishes approximately $\frac{5}{8}$" from the initiation of the filter with low tar cigarettes generally burning to within $\frac{3}{8}$" of the filter. Condensation of moisture on the cigarette and the ashtray is substantially eliminated.

The invention claimed:

1. An ashtray for controlling the rate of burning of an unattended cigarette and for reducing the condensation of tars and moisture around and on the cigarette, comprising in combination:

an ash container formed between side walls;

spaced walls in one side wall forming a first groove;

a liner formed of a good heat conducting material and supported within said first groove to form a second groove having continuous and substantially vertical side walls and a bottom wall extending substantially the length of the cigarette, said side walls being spaced apart a distance slightly less than the cross-sectional diameter of the cigarette so the cigarette can be wedged therebetween and suspended above the bottom wall to form a chamber bounded by the cigarette, a bottom portion of the side walls and the bottom wall; and said liner being held in spaced relationship to said spaced walls of the side wall for heat insulating the from the ash container to control the loss of heat from the liner whereby the member will be heated by the burning cigarette wedged in said groove and prevent condensation on and around the cigarette and the side walls will prevent accidential touching of the heated liner.

2. An ashtray as recited in claim 1 including a wall member closing said chamber near one end of the cigarette.

3. An ashtray as recited in claim 2 wherein said wall member is adjacent the non-burning end of the cigarette.

* * * * *